US006032328A

United States Patent [19]

Harmon et al.

[11] Patent Number: 6,032,328

[45] Date of Patent: Mar. 7, 2000

[54] CREVICE CLEANING TOOL FOR A VACUUM CLEANER APPARATUS

[75] Inventors: Richard Grant Harmon, Manton; Steve Wood, Cadillac, both of Mich.

[73] Assignee: Rexair, Inc., Troy, Mich.

[21] Appl. No.: 09/021,495

[22] Filed: Feb. 10, 1998

[51] Int. Cl.[7] ..... A47L 09/02

[52] U.S. Cl. ..... 15/421; 15/420; 15/416

[58] Field of Search ..... 15/421, 420, 414, 15/415.1, 416, 410

[56] References Cited

U.S. PATENT DOCUMENTS

| | | | |
|---|---|---|---|
| 953,825 | 4/1910 | Gekeler . | |
| 2,867,836 | 1/1959 | Duff | 15/421 |
| 3,230,569 | 1/1966 | Nielsen | 15/414 |
| 3,244,437 | 4/1966 | Belicka et al. | 15/414 |
| 4,329,078 | 5/1982 | Crates et al. . | |
| 4,350,373 | 9/1982 | Fleischer . | |
| 4,542,922 | 9/1985 | Grossauer . | |
| 4,549,779 | 10/1985 | Gromek et al. . | |
| 4,694,529 | 9/1987 | Choiniere . | |
| 4,715,088 | 12/1987 | Haase . | |
| 5,046,761 | 9/1991 | Cordes . | |
| 5,249,830 | 10/1993 | Calmettes et al. . | |
| 5,332,266 | 7/1994 | Canale . | |
| 5,452,493 | 9/1995 | Galindo . | |
| 5,462,311 | 10/1995 | Cipolla . | |
| 5,497,532 | 3/1996 | Glatz | 15/415.1 |
| 5,503,594 | 4/1996 | Karubian et al. | 15/420 |
| 5,533,230 | 7/1996 | Rouda | 15/414 |
| 5,659,923 | 8/1997 | Coombs | 15/420 |

FOREIGN PATENT DOCUMENTS

| | | | |
|---|---|---|---|
| 2815196 A1 | 10/1979 | Germany | 15/421 |

*Primary Examiner*—Robert J. Warden, Sr.
*Assistant Examiner*—Andrew Aldag
*Attorney, Agent, or Firm*—Howard & Howard

[57] ABSTRACT

A crevice cleaning tool having an elongated hollow body portion extending between a first end configured for attachment to a wand of a vacuum cleaner and a second end providing an opening for passage of vacuum cleaning air. The body portion has a base section slidably coupled to an extension section for movement between a retracted and extended position and a locking mechanism selectively locks the extension section to the base section in each of the retracted and extended positions. The body portion includes a first air channel for providing passage of vacuum cleaning air through the body and a second air channel adjacent the body portion extending to the opening of the second end to provide a secondary air inlet into the body portion. A passageway passes between the first and second air channels for providing fluid communication therebetween and to prevent blockage of vacuum cleaning air through the opening of the second end into the body portion.

9 Claims, 4 Drawing Sheets

CREVICE CLEANING TOOL FOR A VACUUM CLEANER APPARATUS

BACKGROUND OF THE INVENTION

1. Field of the Invention

The subject invention relates to a crevice cleaning tool for a vacuum cleaner apparatus, and more particularly, to an extendable crevice cleaning tool having a secondary air passage channel.

2. Description of the Related Art

Vacuum cleaner apparatuses commonly include a flexible vacuum hose extending from the vacuum cleaner for providing clean air suction through the hose to the vacuum. A rigid wand or tube is typically attached to the free end of the hose for receiving and interchanging several different cleaning tools such as a brush assembly, floor attachments, or crevice cleaning tools. The crevice cleaning tools often include a further extension of the wand which may taper in diameter for reaching and cleaning around small or narrow areas such as typically exist under appliances, furniture and corners. Examples of these tapered crevice cleaning tools are exemplified in U.S. Pat. No. 4,694,529 to Choiniere, issued Sep. 22, 1987 and U.S. Pat. No. 4,715,088 to Haase, issued Dec. 28, 1987.

The prior art, however, fails to teach a crevice cleaning tool which is selectively adjustable for extending the length of the tool to assist in reaching difficult and concealed areas. The prior art further fails to teach a crevice cleaning tool having a secondary air passage channel for providing air passage through the tool when the end of the tool opening is closed against a cleaning surface.

SUMMARY OF THE INVENTION

The subject invention relates to a crevice cleaning tool for attachment to a vacuum cleaner apparatus comprising an elongated hollow body portion extending longitudinally between a first end for attachment to the vacuum cleaner apparatus and a second distal end providing an opening into the body portion. A first air channel extends between the first end and the opening of the second end for providing passage of vacuum cleaning air through the body portion. A second air channel is formed in the body portion adjacent the first air channel and extends to the opening of the second end. A passageway passes between the first and second air channels adjacent the opening for providing fluid communication between the first and second air channels to prevent blockage of vacuum cleaning air through the opening of the second end into the body portion.

The subject invention further relates to a crevice cleaning tool for attachment to a vacuum cleaner apparatus comprising an elongated hollow body portion extending longitudinally between a first end for attachment to the vacuum cleaner apparatus and a second end providing an opening for passage of cleaning air through the body portion. The body portion has a base section and an extension section slidably coupled to the base section for longitudinal movement between a retracted position at least partially received within the base section and an extended position telescopingly extending from the base section. A locking mechanism selectively locks the extension section in the retracted and the extended positions.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
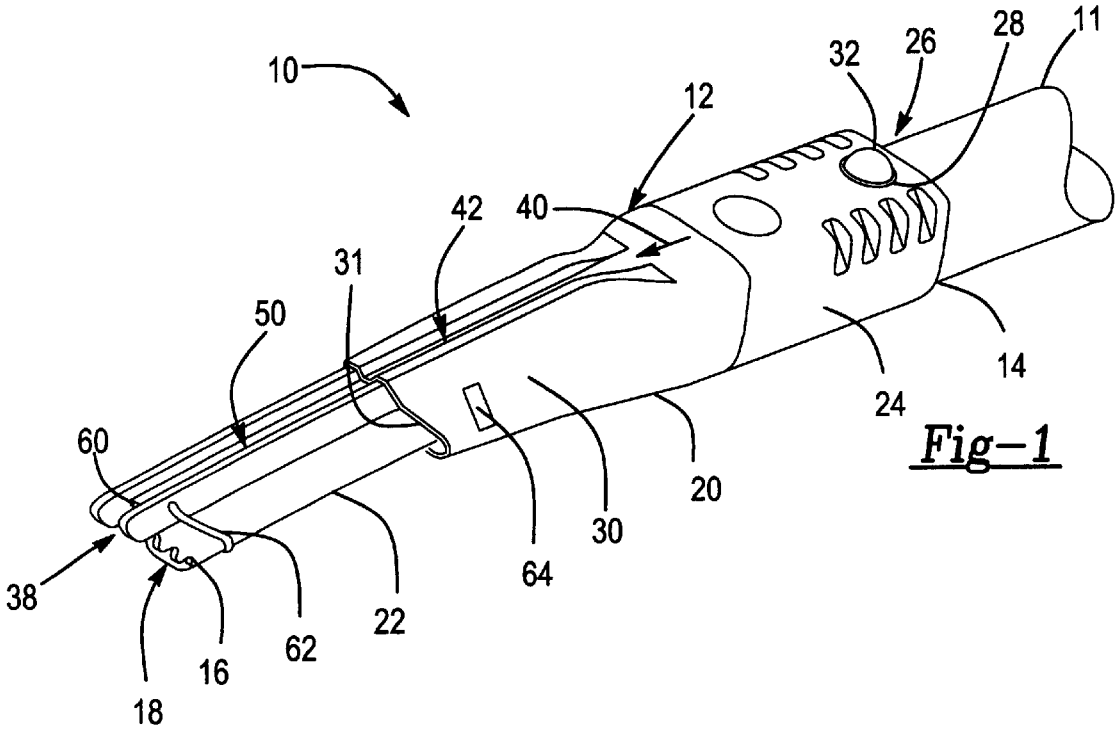
FIG. 1 is a perspective view of the crevice cleaning tool of the preferred embodiment in the extended position.
Figure 2:
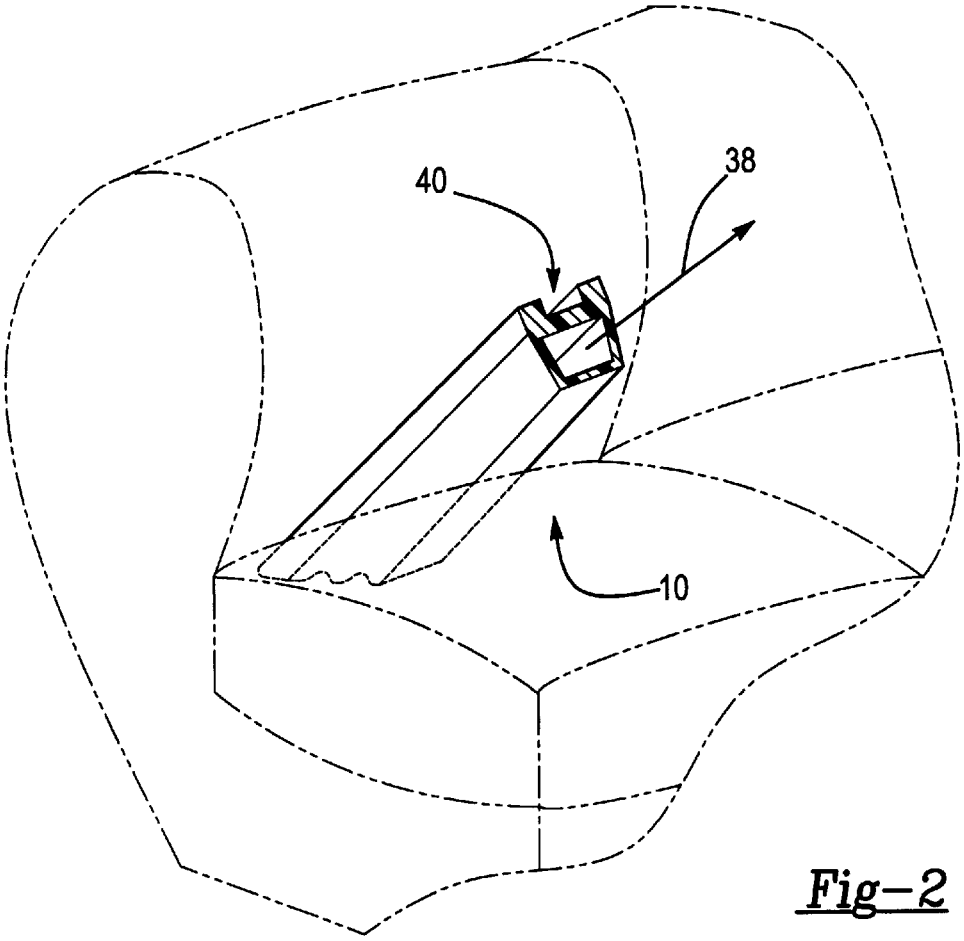
FIG. 2 is an environmental view of the preferred embodiment.
Figure 3:
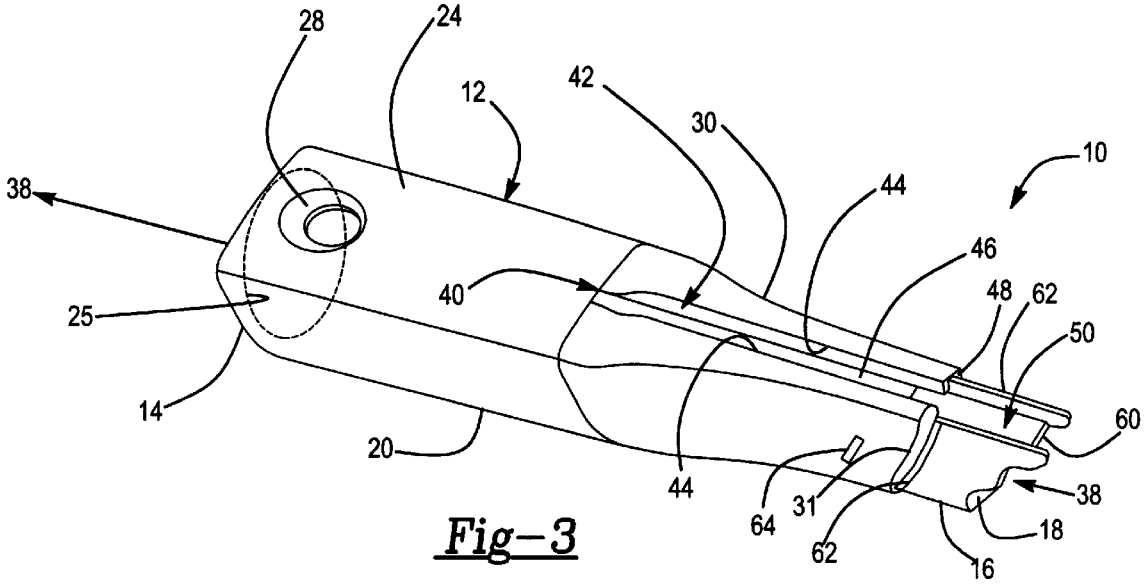
FIG. 3 is a perspective view of the crevice cleaning tool in the retracted position.

Referring to the Figures, wherein like numerals indicate like or corresponding parts throughout the several views, FIGS. 1–4 disclose a crevice cleaning tool 10 for attachment to the hose or wand 11 of a vacuum cleaner apparatus. The crevice cleaning tool 10 comprises an elongated hollow body portion 12 extending longitudinally between a first end 14 for attachment to the wand 11 of the vacuum cleaner apparatus and a second distal end 16 providing an opening 18 into the body portion. The body portion 12 includes a base section 20 and an extension section 22 slidably coupled to said base section 20 for longitudinal movement between a retracted position, as shown in FIG. 3, at least partially received with the base section 22 and an extended position, as shown in FIG. 1, telescopingly extending from the base section 20.

The base section 20 includes a uniform tubular portion 24 having a cylindrical inner surface, an outlet opening 25 at the first end and a retaining device 26 for securing the first end 16 of the body portion 12 to the wand 11 of the vacuum cleaner apparatus. The base section 20 further includes a tapered portion 30 having a generally rectangular configuration extending from a distal open end 31 to the tubular portion 24 for telescopingly receiving the extension section 22 therein. Each of the base section 20 and extension section 22 comprise a thin tube wall with opposing side walls. The retaining device 26 in the preferred embodiment as shown in FIG. 1 has an aperture 28 passing through the tube wall of the base section 20 for receiving a spring loaded detent knob 32 projecting from the wand 11 of the vacuum cleaner apparatus as is commonly known in the art.

Figure 4:
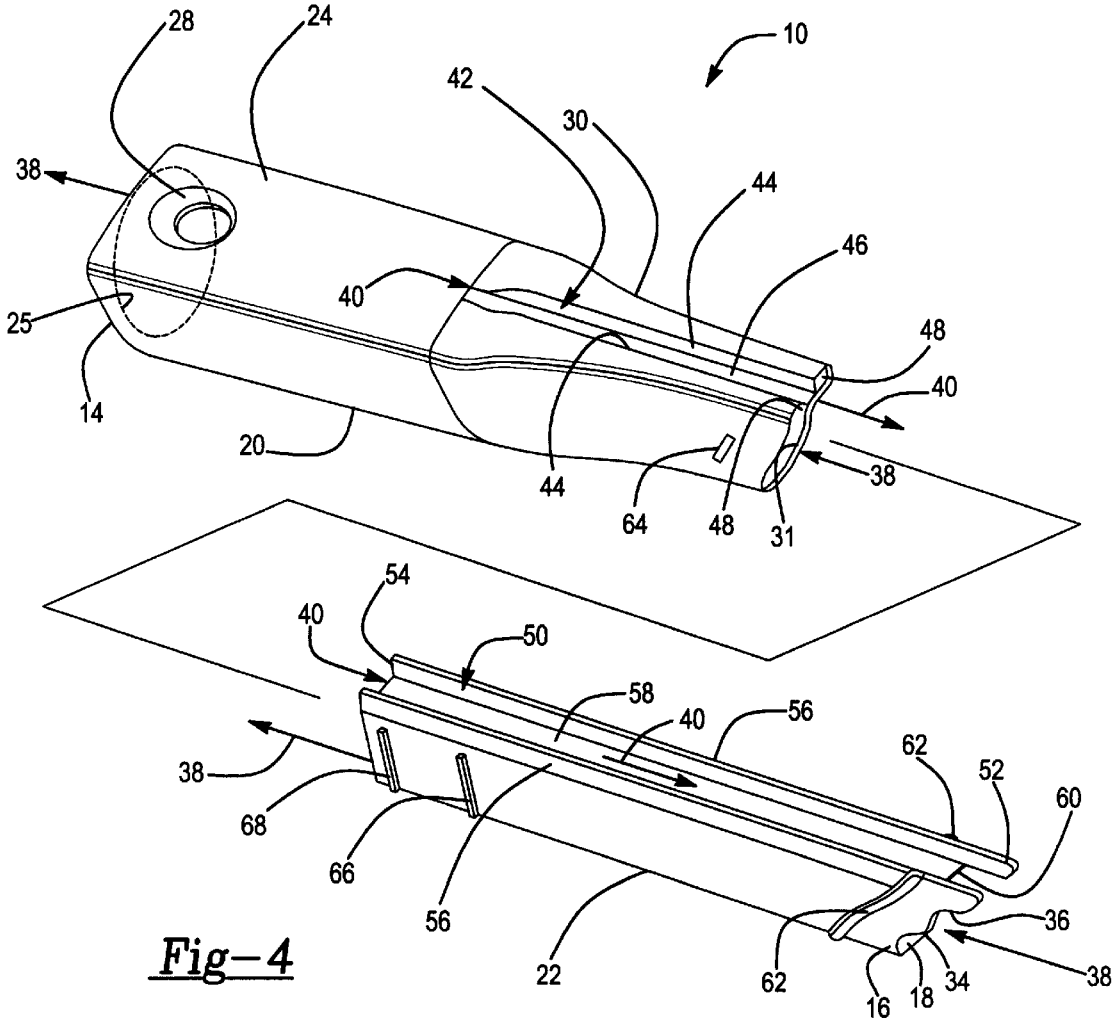
FIG. 4 is an exploded, perspective view of the subject invention.
Figure 5:
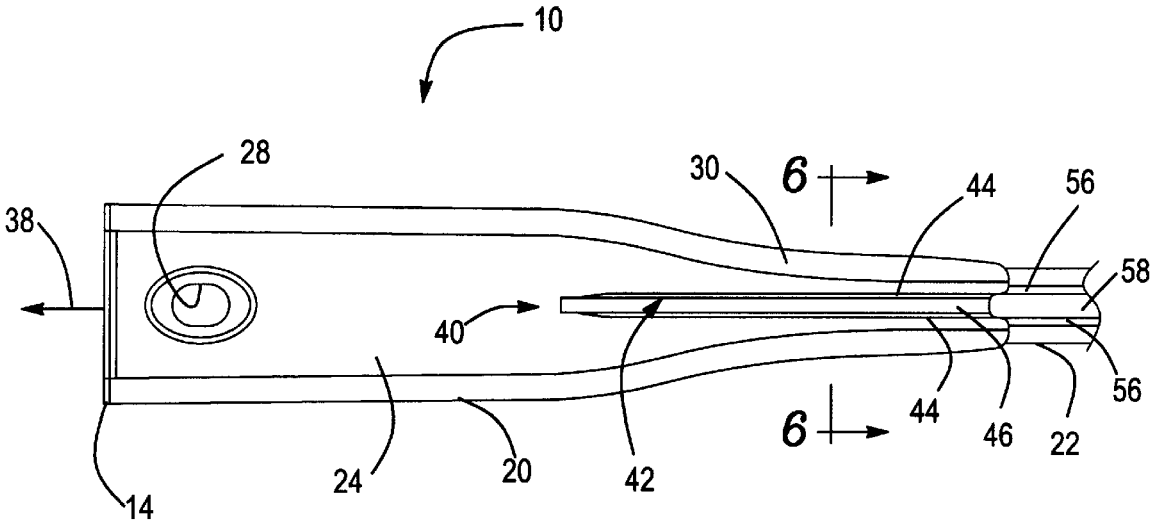
FIG. 5 is a top view of the subject invention with the extension section shown partially broken away in its extended position.

Referring to FIGS. 1 and 4, the extension section 22 has a generally rectangular tubular shape with a chamfered opened end 34. The chamfer end 34 further includes a plurality of stepped notches 36 along opposite sides of the tube wall of the opening 18 for providing openings through sides of the tube walls to prevent blockage of vacuum cleaning air through the opening 18 of the second end 16 into the body portion 12 as will be further described hereinbelow.

The crevice cleaning tool 10 further includes a first air channel 38 extending between the first end 14 and the opening 18 of the second end 16 for providing passage of vacuum cleaning air through the body portion 12 into the wand 11 of the vacuum cleaner apparatus. The first air channel 38 is formed by the tube walls of each of the intercoupled extension 22 and base 20 sections between the first 14 and second 16 ends. That is, the passageway through the extension section 22 formed by the tube walls also forms a first part of the first air channel 38 extending from the opening 18 and the passageway through the base section 20 formed by the tube walls also forms a continuous second part of the first air channel 38 extending from the extension section 22 to the first end 14 which is connected to the wand 11. The vacuum cleaner apparatus provides vacuum cleaning air through the wand 11 to draw the cleaning air from the opening 18 of the second end 16 through the first air channel 38 formed by each of the base 20 and extension 22 sections of the body portion 12. Obviously, the longitudinal length of the air channel 38 may vary as the cleaning tool is moved between the extended and retracted positions. Further, it should be appreciated that the body portion 20 may be one contiguous elongated member, rather than two separate telescoping members as shown without varying from the scope of the invention.

A second air channel 40 is formed in the body portion 20 adjacent to the first air channel 38 and extends to the opening 18 of the second end 16. Specifically, the upper surface of the tapered portion 24 of the base section 20 includes a U-shaped channel 42 extending from the distal open end 31 along the tapered portion 30 to the tubular portion 24 to define a portion of the second air channel 40. The channel 42 is formed by spaced apart, parallel, upright walls 44 interconnected by a bottom wall 46 which are contoured by the tube wall. Each of the upright walls 44 form an inner slot 48 in a portion of the first air channel 38 for receiving part of the extension section 22 as will be discussed in detail below. The upper surface of the extension section 22 also includes a U-shaped channel 50 extending between opposing longitudinal ends 52,54 of the extension section 22. The end 52 defines the opening 18 and the end 54 in received in the distal open end 31 of the tapered portion 30 of the base section 20. The channel 50 is formed by a pair of spaced apart, parallel channel walls 56 interconnected by a bottom wall 58.

A passageway 60 passes between the first air channel 38 and the second air channel 40 adjacent the opening 18 for providing fluid communication between the first 38 and second 40 air channels to prevent blockage of vacuum cleaning air through the opening 18 of the second end 16 into the body portion 12. The passageway 60 is an opening or window cut in the bottom wall 46 of the U-shaped channel 50 immediately adjacent the second end 16 of the extension section 22. The passageway 60 therefore interconnects the fluid flow between the first air channel 38 and the second air channel 40.

In operation, referring to FIG. 2, if the crevice cleaning tool 10 is used to cleaning furniture, or the like, having soft, pliable type cushions, the second end 16 having the opening 18 is inserted into the crevice formed by the intersecting cushions to clean the surfaces and crevice therebetween. If the second end 16 and opening 18 are placed flush against a portion of the surface of the cushion the opening 18 can potentially by closed or blocked and prevent drawing of cleaning air into the tool 10. The stepped notches 36 which form scalloped openings in the side tube walls of the extension section 22 assist in providing passageways into the first air channel 38 to prevent plugging of the opening 18. Additionally, if the notches 36 are also closed by the cushion surface, the upright portion of the adjacent cushion acts to close the top portion of the U-shaped channels 40,50 to create a tube configuration for the second air channel 40. The passageway 60 will remain opened and unblocked to provide fluid communication of the cleaning air between the first air channel 38 and the second air channel 40 and prevent blockage of the air through the opening 18. In other words, with the opening 18 closed against the cushion, the passageway 60 provides a secondary inlet of outside ambient air to pass from the second air channel 40 through the passageway 60 and into the first air channel 38 to the wand 11 of the vacuum. The passageway 60 and the continuous flow of air through the first 38 and second 40 air channel prevents the opening 18 from suctioning against the cushion and prevents blocking of the vacuum cleaning air while the tool 10 is in the crevice.

The passageway 60 is further functional to provide fluid communication between the first 38 and second 40 air channel in any position of the extension section 22 between the extended and retracted positions.

The extension section 22 includes a pair of raised ridges 62 on opposite exterior sides of the tube walls which abut against the distal open end 31 of the base section 20 to define and stop the sliding movement of the extension section 22 into the base section 20 in the retracted position. As can be seen in FIG. 3, the raised ridges 62 have a sinusoidal shape which conforms to the sinusoidal contour of the distal open end 31 of the base section 20 to provide solid mating engagement therebetween.

Figure 6:
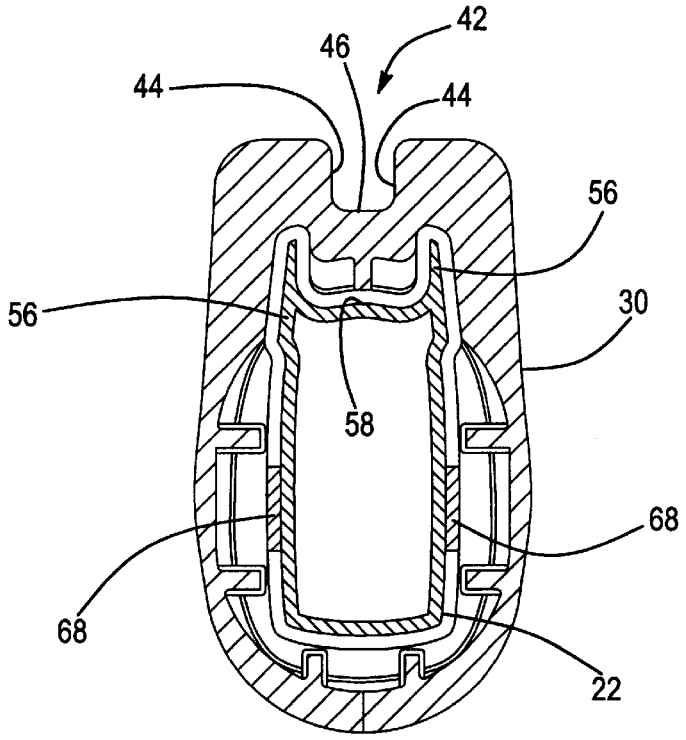
FIG. 6 is a cross-sectional view taken along line 6—6 of FIG. 5.

Referring to FIGS. 4 and 6, the inner surface of the tube wall of the base section 20 include opposing side tabs 64 projecting partially into the air channel for engaging a second pair of raised ridges 66 protruding from opposite sides of the extension section 22 adjacent the end 54 to define and stop the sliding movement of the extension section 22 from the base section 20 in the extended position. Finally, an additional pair of raised ridges 68 are spaced between the end 54 and the ridges 66 for engaging the inner surface of the tube wall of the base section 20 and provide frictional guidance of the extension section 22 along the longitudinal movement in the base section 20 between the extended and retracted positions.

Figure 7:
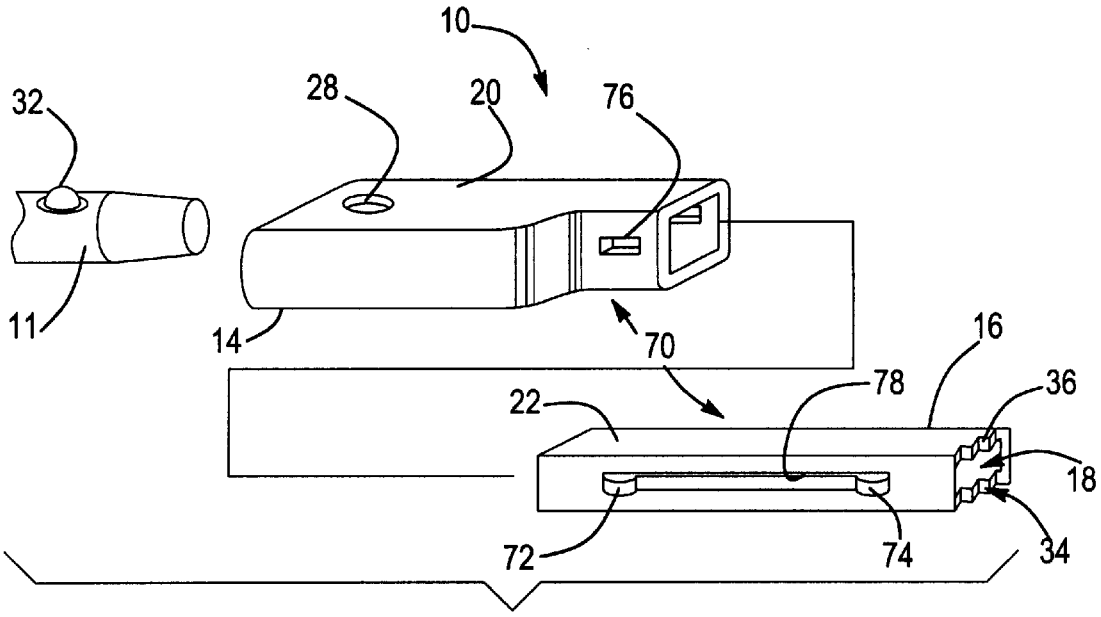
FIG. 7 is an exploded perspective view of an alternative embodiment of the subject invention.
Figure 8:
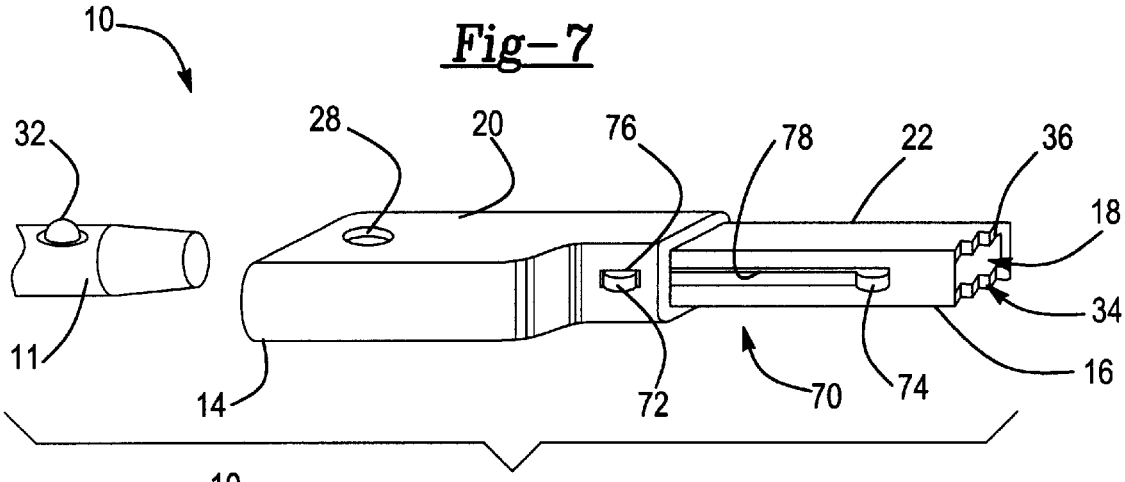
FIG. 8 is a partially exploded, perspective view of the alternative embodiment in the extended position.
Figure 9:
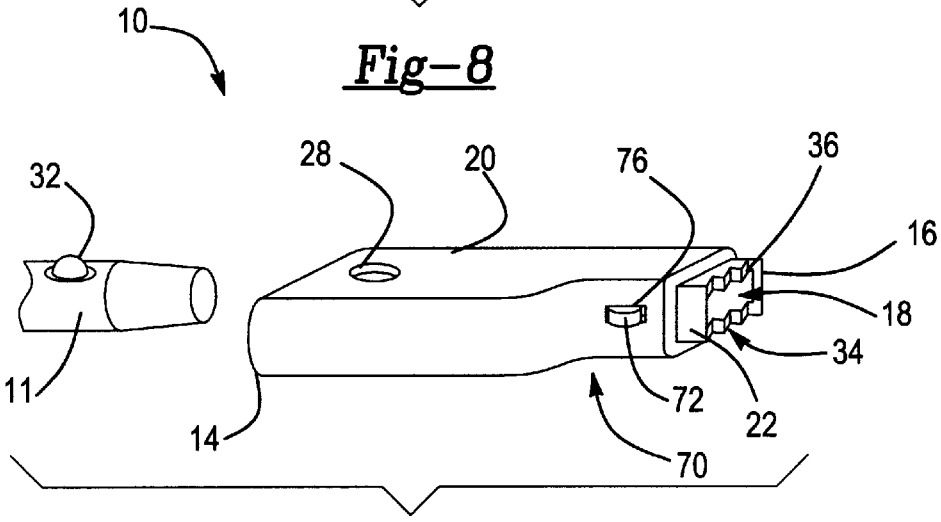
FIG. 9 is a partially exploded, perspective view of the alternative embodiment in the retracted position.

Referring now to FIGS. 7–9, and alternative embodiment of the subject invention is shown including a locking mechanism 70 for selectively locking the extension section 22 in the retracted and extended positions. The locking mechanism 70 comprises a pair of spaced apart detent tabs 72,74 secured to the tube wall of the extension section 22 and an aperture 76 extending through the tube wall in the base section 20 for receiving the detent tabs 72,74 and defining the retracted and extended positions. A channel 78 passes through the tube wall of the extension section 22 and extends longitudinally between the spaced apart detent tabs 72,74.

The opening 31 in the distal end of the base section 20 is dimensioned to slidably receive the extension section 22. In the extended position of FIG. 8, the detent tab 72 is received in the aperture 76 and biased therein by a leaf spring, or the like, for interlocking the base section 20 and extension section 22 in the extended position. If the user desires to retract the tool 10, the detent tab 72 is depressed to release the tab 72 from the aperture 76 and slidably retract the extension section 22 into the base section 20 until the detent tab 74 is received in the aperture 76 and the extension section 22 and base section 20 are interlocked in the retracted position of FIG. 9. Obviously, the detent tabs 72,74 may be spring bias, plastic friction fit or other configurations to provide a positive lock of the extension section 22 in each of the retracted and extended positions without varying from the scope of the invention.

The invention has been described in an illustrative manner, and it is to be understood that the terminology which has been used is intended to be in the nature of words of description rather than of limitation.

Obviously, many modifications and variations of the present invention are possible in light of the above-teachings. It is, therefore, to be understood that within the scope of the appended claims, the invention may be practiced otherwise than as specifically described.

What is claimed is:

1. A crevice cleaning tool for attachment to a vacuum cleaner apparatus comprising:

an elongated hollow body portion extending longitudinally between a first end for attachment to the vacuum cleaner apparatus and a second distal end providing an opening into said body portion;

a first air channel extending between said first end and said opening of said second end for providing passage of vacuum cleaning air through said body portion;

a second air channel formed in said body portion and extending to said opening of said second end; and a passageway passing between said first and second air channels contiguous with said opening for providing fluid communication between said first and second air channels to prevent blockage of vacuum cleaning air through said opening of said second end into said body portion.

2. A crevice cleaning tool as set forth in claim 1 wherein said first air channel includes an elongated tube wall defining said body portion and said second air channel includes a U-shaped channel extending longitudinally parallel to said tube wall from said opening of said second end.

3. A crevice cleaning tool as set forth in claim 2 wherein said passageway includes an opening through said U-shaped channel and said tube wall adjacent said opening of said second end to provide fluid communication between said first and second air channels.

4. A crevice cleaning tool as set forth in claim 3 wherein said body portion includes a uniform tubular portion for securing said first end to the vacuum cleaning apparatus and a tapered portion extending from said tubular portion to said opening of said second end.

5. A crevice cleaning tool as set forth in claim 4 wherein said opening of said second end is a chamfered open end.

6. A crevice cleaning tool as set forth in claim 5 wherein said chamfered open end includes a plurality of stepped notches along opposite sides of said tube wall for providing further openings through said tube wall into said first air channel to prevent blockage of said opening in said second end.

7. A crevice cleaning tool for attachment to a vacuum cleaner apparatus comprising:

an elongated hollow body portion extending longitudinally between a first end for attachment to the vacuum cleaner apparatus and a second distal end providing an opening into said body portion;

a first air channel extending between said first end and said opening of said second end for providing passage of vacuum cleaning air through said body portion;

a second air channel formed in said body portion and extending to said opening of said second end;

a passageway passing between said first and second air channels contiguous with said opening for providing fluid communication between said first and second air channels to prevent blockage of vacuum cleaning air through said opening of said second end into said body portion; and said body portion having a base section and an extension section slidably coupled to said base section for longitudinal movement between a retracted position at least partially received with said base section and an extended position telescopingly extending from said base section.

8. A crevice cleaning tool for attachment to a vacuum cleaner apparatus comprising:

an elongated hollow body portion extending longitudinally between a first end for attachment to the vacuum cleaner apparatus and a second distal end providing an opening into said body portion;

a first air channel extending between said first end and said opening of said second end for providing passage of vacuum cleaning air through said body portion;

a second air channel formed in said body portion and extending to said opening of said second end; and a passageway passing between said first and second air channels at an extreme end opposite said first end of said body portion for providing fluid communication between said first and second air channels to prevent blockage of vacuum cleaning air through said opening of said second end into said body portion.

9. A crevice cleaning tool for attachment to a vacuum cleaner apparatus comprising:

an elongated hollow body portion extending longitudinally between a first end for attachment to the vacuum cleaner apparatus and a second distal end providing an opening into said body portion;

a first air channel defining a first flow path extending between said first end and said opening of said second end for providing passage of vacuum cleaning air through said body portion;

a second air channel defining a second flow path formed in said body portion and extending to said opening of said second end, said second flow path generally parallel to said first flow path; and a passageway transversely passing between said first and second flow path at an extreme end opposite said first end for providing fluid communication between said first and second air channels to prevent blockage of vacuum cleaning air through said opening of said second end into said body portion.

* * * * *